United States Patent [19]

Rabitsch

[11] Patent Number: 4,648,558

[45] Date of Patent: Mar. 10, 1987

[54] SPRINKLER ASSEMBLY

[76] Inventor: Benjamin F. Rabitsch, P.O. Box 1062, Millen, Ga. 30442

[21] Appl. No.: 732,178

[22] Filed: May 9, 1985

[51] Int. Cl.[4] ..... B05B 3/04; B05B 3/10

[52] U.S. Cl. ..... 239/228; 239/236; 239/240; 239/601; 239/DIG. 1; 239/512; 239/232

[58] Field of Search ..... 239/97, 228, 231, 232, 239/236, 237, 240, 381, 382, 389, 589, 590, DIG. 1, 505, 507, 511-513, 601

[56] References Cited

U.S. PATENT DOCUMENTS 1,511,940 10/1924 Boyer ..... 239/590 X
4,277,029 7/1981 Rabitsch ..... 239/DIG. 1 X

FOREIGN PATENT DOCUMENTS 133148 6/1949 Australia ..... 239/590

*Primary Examiner*—Joseph F. Peters, Jr.
*Assistant Examiner*—Mary Beth O. Jones
*Attorney, Agent, or Firm*—Harvey B. Jacobson

[57] ABSTRACT

A sprinkler assembly having a discharge nozzle for discharging water at a substantially constant volume and velocity driven rotatably about a vertical axis by a water turbine and gear drive for rotating said nozzle at varying rotational speeds in each cycle of rotation for varying the quantity of water discharged along the radial land areas extending from the axis of rotation as the length of the radial land area varies when irrigating a non-circular land area. A movable diffuser is mounted on the nozzle and is drivingly connected with the gear drive by a cam arrangement to vary the radial length and pattern of discharge of water corresponding to the rotational speed of the nozzle with the greatest radial length of discharge of water occurring when the nozzle is travelling at its slowest rotational speed. The diffuser includes a blade movable laterally of the nozzle to split the stream of water as it is being discharged and a radi-used groove formed in the upper surface of the water passageway in the nozzle opposed relation to the tip of the blade with the blade causing back pressure with part of the water being caused to flow around the periphery of the groove and to be discharged downwardly across the water passageway for diffusing the stream of water and varying the pattern of water discharged from the nozzle. Ridge-type baffles are formed on opposite walls of the passageway downstream of the blade to breakup the stream of water into a finer spray for improving uniformity of distribution.

13 Claims, 9 Drawing Figures

SPRINKLER ASSEMBLY

BACKGROUND OF THE INVENTION

1. Field of the Invention

This invention relates to a sprinkler having a rotary nozzle of unique construction utilizing a diffuser that continuously varies the characteristics of the discharge pattern for even distribution of water onto square or other polygonally shaped land areas with the nozzle being rotatably driven by a water powered drive mechanism and the nozzle diffuser also being driven by the water powered drive mechanism and constructed so as to vary not only the quantity of water discharged onto each increment of the land area but also varying the length of trajectory of the water to evenly cover various shapes of land areas. The same basic principle is used in an embodiment of the invention used as a nozzle to apply fertilizer from a vehicle with the discharge pattern in this use being constant.

2. Description of Related Art

My prior U.S. Pat. No. 4,277,029, issued Jul. 7, 1981, for Irrigation Sprinkler, discloses a water-driven rotatable nozzle which has a drive speed varied by a gear drive mechanism with the nozzle including a diffuser controlled by the gear drive mechanism which discharges water in a manner to evenly irrigate various land area shapes. While the device disclosed in that patent performed satisfactorily, the specific details of the water powered gear drive mechanism, the nozzle and diffuser have been substantially improved to provide a sprinkler assembly which is capable of more effectively irrigating a land area while utilizing totally different and unobvious structural arrangements. The prior patents made of record in U.S. Pat. No. 4,277,029, which are also made of record in this application, also fail to disclose the innovative structural features incorporated in this invention.

SUMMARY OF THE INVENTION

An object of the present invention is to provide a sprinkler assembly for evenly irrigating a square or other polygonal land area with a centrally located rotatable nozzle powered by a water driven gear mechanism which varies the rotational speed of the nozzle and varies the operational characteristics of a diffuser associated with the nozzle so that all increments of the land area will receive substantially the same quantity of water.

Another object of the invention is to provide a sprinkler assembly in accordance with the preceding object in which the nozzle is driven by a water turbine which has a water inlet at the center and equal distribution of thrust to eliminate side thrust and reduce turbulence in the water stream.

A further object of the invention is to provide a sprinkler assembly in accordance with the preceding objects in which the nozzle diffuser includes a radiused groove internally of the water passageway combined with a bevelled blade member movable toward and away from the downstream end of the groove for breaking up the bottom of the water stream and causing a water dispersion which, together with the variation in rotational speed will vary the characteristics of the water pattern discharged from the nozzle in a manner to evenly cover a land area.

Still another object of the invention is to provide a unique nozzle with diffuser incorporated therein that may be used in a spray boom or other water nozzle arrangement and to provide a gear drive for providing a varied output speed.

Yet another important object of the invention is to provide a sprinkler assembly which utilizes a minimum number of parts all of which are relatively simple in construction and easy to assemble and repair if necessary thereby rendering the sprinkler assembly economically feasible, dependable, long lasting and effective for evenly distributing water over a given land area.

A still further object of this invention is to provide a diffuser nozzle which can be arranged in back-to-back relation at the rear of a fertilizer applying vehicle for replacing conventional spray booms and providing an even but constant spray pattern over a predetermined horizontal distance transversely of the vehicle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
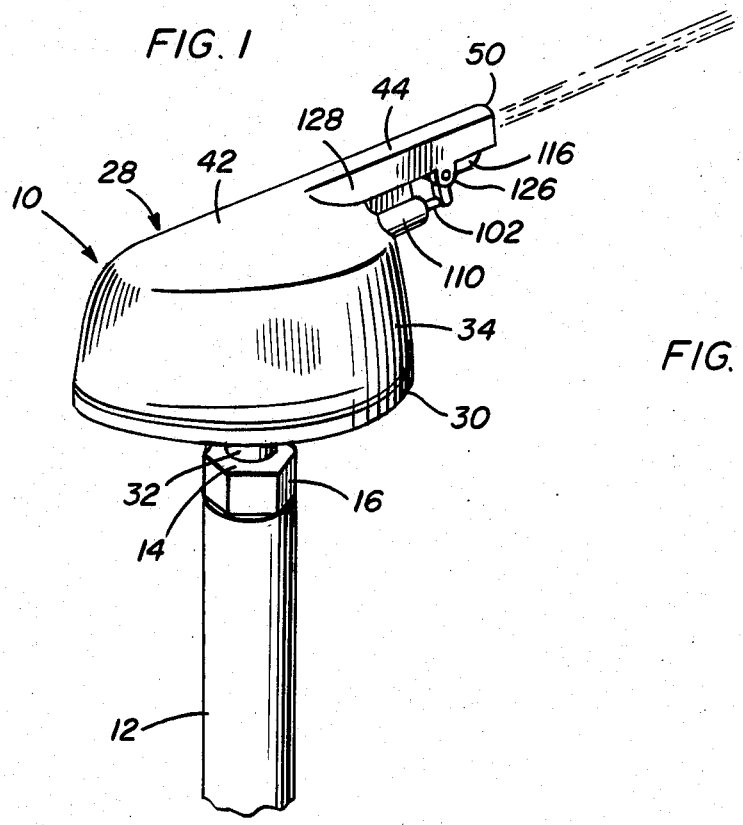
FIG. 1 is a perspective view of the sprinkler assembly of the present invention.

Referring now specifically to FIGS. 1-8 of the drawings, the sprinkler assembly illustrated therein is generally designated by reference numeral 10 and is mounted on a vertical riser pipe 12 by a sleeve 14 having flat portions 16 at the upper end thereof for receiving a wrench or the like and an externally threaded portion 18 which is threaded into the internally threaded pipe 12. A tubular vertical stem 20 is positioned in the sleeve 14 and extends slightly below the lower end thereof and is provided with an external groove 22 for receiving a split ring or the like and the longitudinal portion of the stem 20 received in the sleeve 14 is provided with a groove and O-ring seal 24 to provide for flow of water upwardly through the tubular passageway 26 in the stem 20 without leakage between the stem 20 and the sleeve 14.

Figure 2:
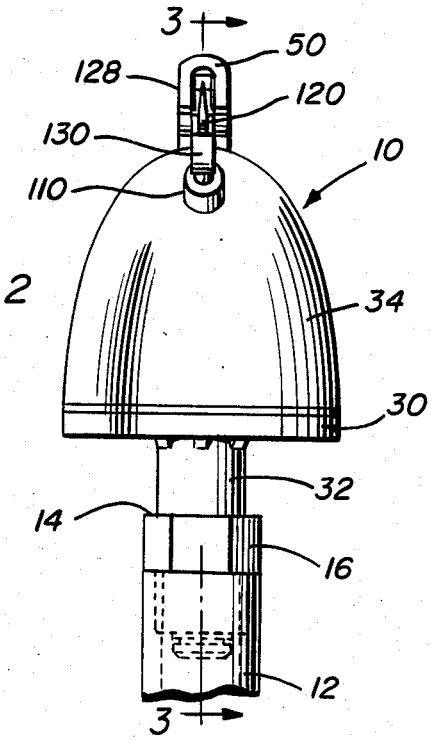
FIG. 2 is an elevational view thereof taken from the discharge side of the assembly.
Figure 4:
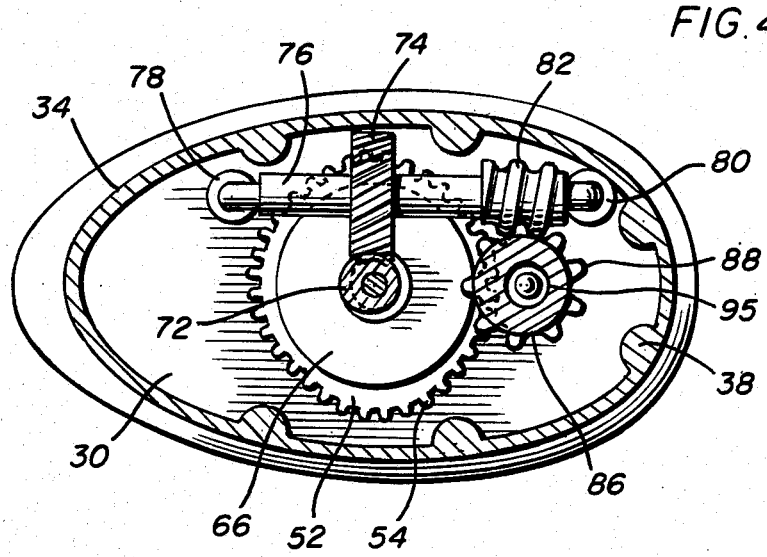
FIG. 4 is a horizontal sectional view taken substantially upon a plane passing along section line 4—4 on FIG. 3.

The sprinkler assembly 10 includes a hollow housing 28 including a generally flat bottom plate 30 having a centrally disposed depending tubular extension 32 which receives the stem 20 and is rotatable about a vertical axis defined by the center of the stem 20. Mounted detachably on the plate 30 is an inverted hollow member 34 having a lower end corresponding in shape and configuration to the plate 30 which is generally oval-shaped as illustrated in FIG. 4 with the periphery of the plate 30 having the hollow member 34 secured thereto by screw-threaded fasteners 36 which extend up through the plate 30 into hollow bosses 38 and a gasket 40 is positioned between the plate and hollow member 34 thereby detachably but sealingly securing the hollow member 34 to the plate 30. The upper portion of the hollow member 34 is inclined upwardly as at 42 and includes a laterally extending and upwardly inclined nozzle 44 having a water passageway 46 formed therein. The passageway 46 is generally cylindrical in configuration with the major portion of the passageway 46 being defined by a generally cylindrical internal wall 48 which extends substantially throughout the length of the hollow member 34 terminating at its inner end in spaced relation to one wall thereof and extending beyond the other wall as a projecting nozzle having an inclined terminal end edge 50 with the projecting portion of the nozzle 44 being generally of inverted U-shaped configuration as illustrated in FIG. 2.

Figure 3:
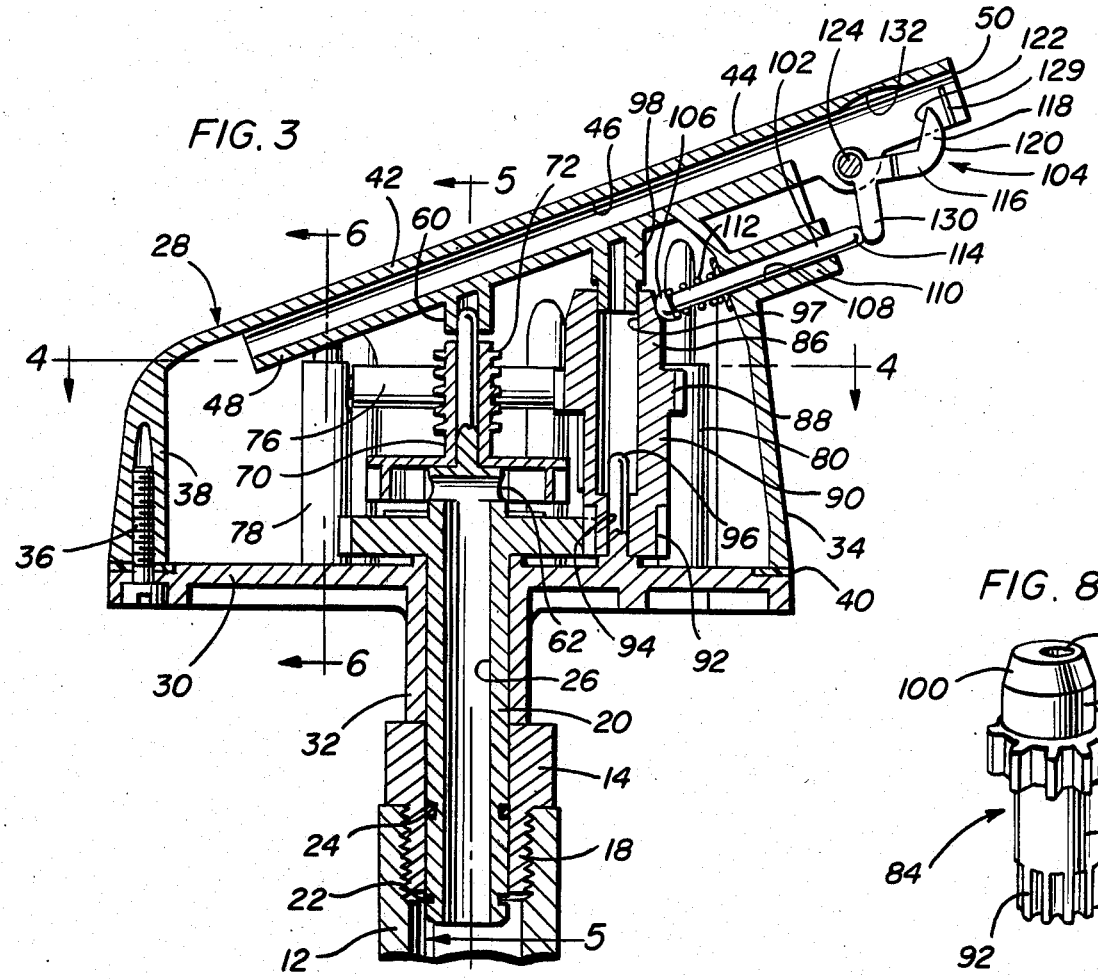
FIG. 3 is a vertical sectional view taken substantially upon a plane passing along section line 3—3 on FIG. 2 illustrating the structural details of the invention.
Figure 8:
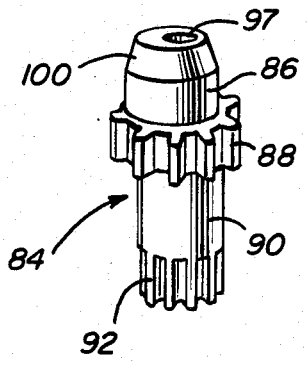
FIG. 8 is a perspective view of the combination gear and cam member forming part of the present invention.
Figure 5:
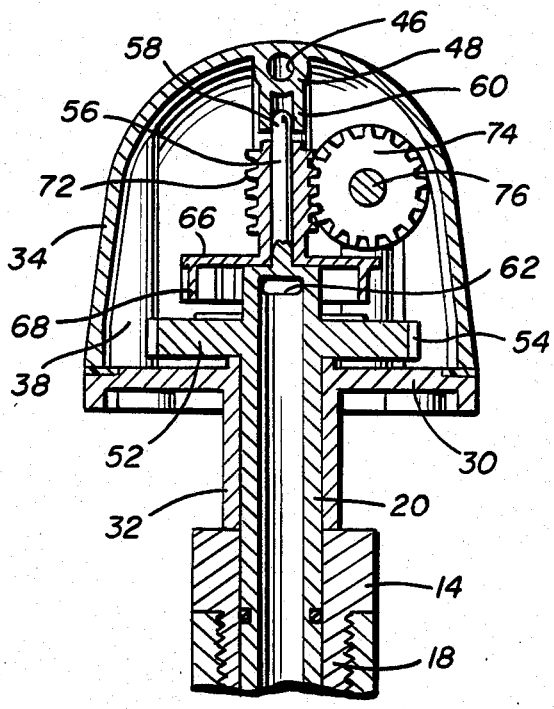
FIG. 5 is a vertical sectional view taken substantially upon a plane passing along section line 5—5 on FIG. 3.
Figure 6:
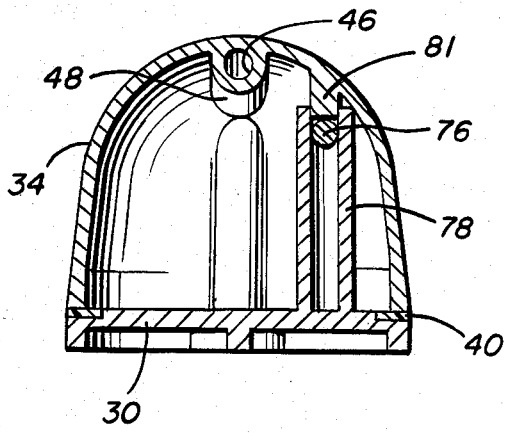
FIG. 6 is a vertical sectional view taken substantially upon a plane passing along section line 6—6 on FIG. 3.
Figure 7:
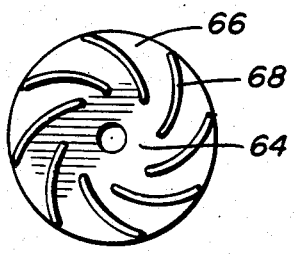
FIG. 7 is a bottom plan view of the water turbine wheel forming part of the drive mechanism.

The upper end of the stem 20 includes a gear 52 having external teeth 54 on the periphery thereof with the stem 20 extending upwardly beyond the gear 52 and terminating in an upwardly extending axial extension 56 of reduced diameter which has a rounded upper end 58 received in a depending guide sleeve 60 integral with the bottom of the cylindrical wall 48 as illustrated in FIG. 3 to stabilize the rotational axis of the housing 28 when it rotates about the center of the stem 20. Also, at the junction between the stem 20 and the extension 56, the stem 20 includes a transverse passageway 62 for discharging water laterally into the hollow central area 64 of a turbine wheel 66 having a plurality of downwardly extending curved blades 68 arranged peripherally of the hollow central area 64 and adapted to receive water discharged from the passageway 62 and thus cause rotation of the turbine wheel 66. The upper end of the turbine wheel 66 includes a sleeve 70 which is rotatably engaged with the axial extension 56 and the exterior of the sleeve 70 includes a spiral gear tooth 72 forming a worm gear which engages a worm wheel 74 mounted on a horizontally disposed shaft 76 in offset and perpendicular relation to the rotational axis of the worm gear 72 as illustrated in FIG. 5 with the ends of the worm wheel shaft 76 being journalled in the slotted upper ends of upstanding projections 78 and 80 rigid with the plate 30 as illustrated in FIGS. 4 and 6 and held therein by depending projections 81. The worm wheel shaft 76 includes a spiral gear tooth forming a worm gear 82 thereon in spaced relation to the worm wheel 74 as illustrated in FIG. 4 so that the turbine wheel 66 drives the worm gear 72 which in turn rotates the worm wheel 74 and shaft 76 and worm gear 82. The worm gear 82 and the gear 52 are in meshing engagement with a gear cam assembly 84 in the form of a tubular member 86 having a worm wheel 88 thereon in meshing engagement with the worm gear 82 and a lower cylindrical portion 90 having a spur gear 92 formed thereon in meshing engagement with the gear 52. The lower end of the gear cam assembly is provided with a small diameter bore 94 which receives and rotates on an upstanding pin or shaft 96 fixed to the plate 30. The remainder of the gear cam assembly 84 is provided with a larger diameter bore 97 receiving and rotatably journalled on a depending tubular pin or shaft 98 fixed to the underside of the cylindrical wall 48 forming part of the water passageway 46 as illustrated in FIG. 3. The upper end of the gear cam assembly 84 is provided with a tapered cam surface 100 which engages with one end of an actuating pin 102 for a diffuser assembly generally designated by numeral 104. The pin 102 includes a rounded head 106 forming a follower for engagement with the cam surface 100 with the shank of the pin being reciprocally slidably mounted in a passageway 108 formed in the hollow member 34 and in a projection 110 thereon which generally parallels the nozzle projection 44 in underlying relation thereto as illustrated in FIG. 3. A coil spring 112 is oriented between the head 106 on the pin 102 and the interior of the hollow member 34 to provide a small force biasing the follower head 106 into contact with the cam surface 100. The opposite end of the pin 102 is rounded as indicated by numeral 114 to actuate the diffuser assembly 104.

The diffuser assembly 104 includes a relatively thin and narrow blade or plate 116 having an angulated upwardly extending blade portion 118 having a rounded outer edge 120 and a bevelled or sharpened straight edge 122. The plate or blade 116 is pivotally supported from the bottom of the projection 44 by a pivot stud 124 unitary with the blade 116 to enable pivotal movement of the diffuser assembly 104 with the pivot stud 124 extending between depending ears or lugs 126 which are integral with the generally parallel side walls 128 of the inverted U-shaped projecting nozzle 44. The plate or blade 116 is provided with a projecting arm 130 in generally perpendicular relation to the plate or blade 116 and integral therewith with the arm 130 being engaged by the rounded end 114 of the pin 102 so that as the pin 102 is reciprocated by its engagement with the rotating cam surface 100, the diffuser assembly 104 will be pivoted about the axis of the pivot stud 124. As illustrated in FIG. 3, the blade 118 is positioned between the parallel side walls 128 and can move arcuately inwardly and outwardly in relation thereto. The upper wall of the passageway 46 adjacent the discharge end 50 is provided with an arcuate groove or recess 132 which cooperates with the blade 118 to vary the characteristics of the water discharge pattern. The groove 132 is radiused with the diffuser blade being oriented just downstream of the groove with the diffuser blade splitting the water stream and creating back pressure which causes some water to flow around the upper periphery of the radius and across the passageway 46. The radius of the groove is essential to break up the bottom of the stream of water and the location and dimensional characteristics of the blade 118 are essential to split the water flow and create some back pressure which causes some of the water to flow upwardly and through and around the radius and across the water path thus diffusing the water and changing the pattern of discharge in accordance with movement of the diffuser assembly 104 in accordance with the rotation of the cam surface 100.

Downstream of the blade 116, the interior of each sidewall 128 is provided with a stream baffle 129 which is in the form of a shallow rib or ridge extending perpendicular to the bottom edge of the sidewall 128. These stream baffles help to break the stream into a finer spray and improves uniformity of distribution throughout the area to be irrigated.

As illustrated in FIG. 3, the gear cam 84 rotates about a vertical axis defined by the pins 96 and 98 with the bores or passageways 94 and 97 being offset or eccentrically related to the gear 92 but not to the gear 88 so that the gear 88 remains in mesh with the gear 82 and the gear 92 will remain in mesh with the gear 52. The gear 52 is dual elliptical so that as the radius of the gear 52 changes, the radius of the gear 92 will also change thereby providing variation in the rotational speed of the nozzle 44 and its associated housing 28 so that as the distance to the perimeter of the land area to be irrigated increases, the rotational speed will be slowed and the diffuser assembly will be moved to a position to enable maximum discharge of water with the pattern of the water discharged being such that an equal amount of water will be discharged on each increment of the length of the land area being irrigated from the sprinkler assembly to the perimeter of the land area. As the nozzle 44 is rotated towards a portion of the land area having a shorter distance to the perimeter, the speed of the housing and nozzle will be increased and the diffuser assembly will be moved inwardly to vary the pattern of discharge as well as the time of dwell of the sprinkler assembly in each increments of its rotation to assure even distribution of water over all of the land area being irrigated.

The attachment of the stem 20 to the standpipe 12 retains the stem in stationary position but this structure is such that it will be permitted to swivel to form a slip clutch to prevent damage to the gears in the event rotational movement of the housing 28 is prevented or the housing 28 is manually rotated. The ratio of the cam surface 100 may be varied to alter the pattern of water discharge due to the diffuser assembly 104 by moving the gear cam 84 upwardly or downwardly by providing a shim under the gear cam 84 or varying the thickness of the gasket 40 between the plate 30 and the hollow member 34.

The turbine wheel 66 may have the blades 68 only at the tip end thereof with the passageway 62 being in the form of a hollow cavity with a plurality of openings therein with the number of blades on the turbine wheel being the same as the number of holes, for example, eight blades and eight holes so that as the water enters the turbine from the center and moves outwardly against the blades, it will not produce any side thrust. The water passage 46 extending throughout the length of the housing 28 and projecting out to the nozzle tip 50 stabilizes the water column and reduces turbulence in the water column as it moves to the nozzle tip 50 so that the passageway 46 will provide a water stream or column having substantially no turbulence.

Figure 9:
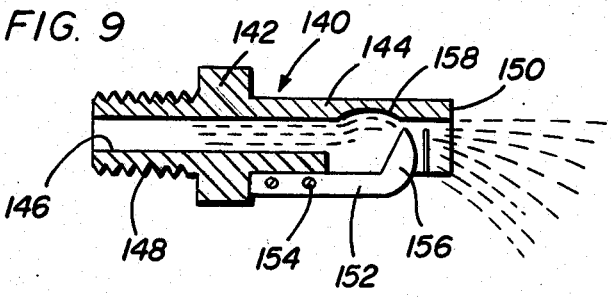
FIG. 9 is a sectional view illustrating the nozzle with diffuser used in lieu of a spray boom at the rear of a fertilizer applying vehicle for discharging a constant pattern of liquid fertilizer transversely of the path of movement of the vehicle.

FIG. 9 illustrates another embodiment of the nozzle and diffuser designated by reference numeral 140 which is adapted for use in combination with liquid fertilizer spraying vehicles or similar type spraying equipment. Typical liquid fertilizing applying vehicles include a large liquid tank and an elongated spray boom which extends transversely of the rear of the vehicle and includes a plurality of spray nozzles spaced longitudinally therefrom for spraying liquid fertilizer or similar material onto the ground surface. The portions of the boom which extend laterally of the vehicle are usually pivotally supported for movement to a folded position alongside the vehicle for movement over-the-road, through gates and the like. In addition to the relatively high initial cost of the spray booms, they are frequently damaged by coming into contact with obstructions such as trees, fence posts and the like. Also, in order to change the application rate, all of the spray nozzles must be changed.

Thus by mounting two nozzles and diffusers 140 in back-to-back relation at the rear of the vehicle, the number of nozzles required will be boom will be completely eliminated and when the volume is changed only two nozzles will be changed thereby reducing initial cost, weight, maintenance and repair and time required to change the rate of application of liquid material.

In this embodiment, the nozzle and diffuser 140 includes a hollow body 142 defining a nozzle 144 with a generally cylindrical passageway 146 extending therethrough. The body 142 is externally threaded at 148 at one end for threading onto a supply pipe. The other end of the body 142 is generally U-shaped, open along the bottom and terminating in an end edge 150 perpendicular to the flow path. A diffuser 152 is mounted on the bottom of the body 142 by fasteners 154 extending therethrough and through lugs or flanges along the bottom of the body 142. The end of the diffuser 152 includes an upwardly extending blade 156 of a structure similar to blade 116 which is positioned in opposed relation to an arcute groove or recess 158 in the top wall of the passageway 146 and upstream of baffles 159. The function of the blade 156, recess 158 and baffles 159 in FIG. 9 is the same as that of blade 116, recess 132 and baffles 129 in FIG. 3 except that the blade is stationary and thus produces a constant spray pattern whereas the blade 116 is movable to provide a continuously varying spray pattern.

Since the fertilizer nozzle moves in a linear path with the spray pattern being in perpendicular relation thereto with the spray pattern having an even dispersal from end to end rather than being variable as in the movable diffuser 104 in FIGS. 1–8. This fixed pattern is accomplished by determining the proper radius of the recess and setting of the diffuser blade 156 so that when the nozzle is rigidly attached to a supply pipe, no adjustment need be made. Also, the nozzle and diffuser concept may be incorporated into a hand held nozzle attached to a garden hose or the like with the constant spray pattern being oriented in a generally vertical plane rather than in a conical pattern as produced by conventional garden hose nozzles.

It is pointed out that the particular configuration of the elliptical gear 52 and its association with the gear 92 is such that it can be varied to correspond to the general shape of the land area being irrigated. For example, the gear could be square, rectangular, triangular or any polygonal shape with any number of sides.

All of the components of the invention may be constructed of plastic material except for the O-ring and preferably, the diffuser assembly 104 is constructed of metal or plastic material in order to assure long life and effective diffusion of the water stream. The components may be easily assembled and disassembled for repair of replacement by merely removing the screw-threaded fasteners and lifting the inverted hollow member 34 after which all of the internal components may be removed and replaced if necessary.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sprinkler assembly comprising a discharge nozzle for discharging water at a substantially constant volume and velocity, means rotatably supporting said nozzle for movement about a vertical axis with the nozzle discharging water in a lateral path, and drive means rotating said nozzle at varying rotational speeds in each cycle of rotation for varying the quantity of water discharged along the radial land areas extending from the axis of rotation as the length of the radial land area varies when irrigating a non-circular land area, said nozzle including movable diffuser means, said diffuser means including an actuating mechanism drivingly connected with the drive means for the nozzle to vary the radial length and pattern of discharge of water corresponding to the rotational speed of the nozzle with the greatest radial length of discharge of water occuring when the nozzle is travelling at its slowest rotational speed, said diffuser means including a blade movable laterally of the nozzle to split the stream of water as it is being discharged from the nozzle when the blade intersects the stream of water, said discharge nozzle including a water passageway extending laterally outwardly and in an upwardly inclined direction with respect to the axis of rotation, a radiused groove formed in the upper surface defining the water passageway, said blade having movable mounting means for movement laterally inwardly and outwardly from the bottom of the water passageway in opposed relation to the groove with the tip of the blade being adjacent to but downstream from the groove whereby the blade, when inserted into the water passageway, causes back pressure with part of the water being caused to flow around the periphery of the groove and to be discharged downwardly across the water passageway for diffusing the stream of water and varying the pattern of water discharged from the nozzle.

2. The sprinkler assembly as defined in claim 1 wherein said blade includes a tapered edge facing upstream when the blade intersects the stream of water moving in the passageway, said tapered edge being inclined toward the downstream end of the nozzle, said mounting means for the blade including a pivot support to enable pivotal movement of the blade laterally of the water passageway.

3. The sprinkler assembly as defined in claim 2 wherein said actuating mechanism for the diffuser means includes a reciprocating rod mounted on the sprinkler assembly with one end engaged with the blade and cam means engaging the other end of the rod with the cam means being drivingly connected with the drive means for the nozzle.

4. The sprinkler assembly as defined in claim 3 wherein said drive means for the nozzle includes a stationary gear, a rotatable drive gear having the cam means mounted thereon, said drive gear being constantly meshed with the stationary gear, and water drive means connected with the drive gear for rotating the drive gear, said stationary gear and said drive gear having offset peripheral portions whereby rotational movement of the gears will vary the rotational speed of the nozzle.

5. The sprinkler assembly as defined in claim 4 wherein said drive means is oriented in a hollow housing, said water drive means including a turbine wheel receiving water centrally from a supply pipe with the water discharged from the turbine subsequently being discharged through the water passageway to the nozzle, a worm gear assembly interconnecting the water turbine and drive gear for rotating the drive gear at a substantially constant speed corresponding to the water volume and pressure passing through the water turbine and being discharged from the nozzle, said drive gear and cam means being of unitary construction with the cam means being oriented in spaced relation to the drive gear and including a cam surface engaged with one end of the rod to operate the diffuser blade.

6. The sprinkler assembly as defined in claim 5 wherein said housing includes a bottom plate with a depending sleeve, said stationary gear including a hollow stem received in the sleeve and connected to a vertical supply standpipe with the stem having the stationary gear on the upper end thereof with the hollow interior of the stem extending upwardly through the gear and discharging water through ports into the center of said turbine wheel, said turbine wheel having a plurality of radial curved blades thereon for rotating the turbine wheel as water is discharged into the housing.

7. The sprinkler assembly as defined in claim 6 wherein said turbine wheel includes an upwardly extending sleeve having a worm gear thereon in meshing engagement with a horizontally rotatable worm gear oriented in the housing, said horizontal worm gear having a worm gear drive to a tubular member having the drive gear on the lower end thereof and the cam surface on the upper end thereof.

8. The sprinkler assembly as defined in claim 5 wherein said housing is of generally oval-shape in plan configuration and includes an upwardly inclined top wall having the nozzle projecting from one end thereof with said water passageway extending substantially completely across the longer dimension of the housing to provide an elongated water passageway to reduce turbulence in the water stream before it is discharged from the nozzle.

9. A discharge nozzle for liquid material having a longitudinally extending passageway communicating a source of liquid with a discharge end of the nozzle and diffuser means assocaited with the liquid passageway in the nozzle to determine the pattern of discharge of liquid from the nozzle, said diffuser means including a blade inserted into the liquid passageway to split the stream of liquid as it discharges from the nozzle, said blade being inserted laterally of the nozzle into intersecting relation to the stream of liquid passing therethrough, the inner surface of the passageway in opposed relation to the blade including a radiused groove through which some of the liquid passes when the blade is in intersecting relation to the stream of liquid due to back pressure caused by the blade whereby the liquid material passing through the groove then passes across the path of the stream of liquid to diffuse the stream of liquid and vary the pattern of discharge of the liquid from the nozzle.

10. The structure as defined in claim 9 wherein said blade is located slightly downstream from the groove and including a tapered inclined edge facing the liquid stream slightly downstream of the groove to split the stream of liquid and cause back pressure for movement of a portion of the liquid around the radius of the groove in an arcuate path for movement laterally of the stream of liquid with the passageway, for the stream of liquid downstream from the blade being laterally open on the side of the passageway receiving the blade to enable this portion of the stream of liquid to be dispersed in a generally larger area than if the stream of liquid was confined on the downstream side of the blade.

11. The structure as defined in claim 9 together with shallow ridge-type baffles downstream of the blade, said nozzle having generally parallel sidewalls with the baffles formed thereon, said groove being formed in the top wall of the nozzle and upstream from the baffles.

12. A sprinkler assembly comprising an elongated, rigid discharge nozzle for discharging water at a substantially constant volume and velocity, means rotatably supporting said nozzle for movement about a vertical axis with the nozzle discharging water in a lateral path, and drive means rotating said nozzle at varying rotational speeds in each cycle of rotation for varying the quantity of water discharged along the radial land areas extending from the axis of rotation as the length of the radial land area varies when irrigating a noncircular land area, said nozzle including movable diffuser means inwardly of the discharge end of the nozzle, said diffuser means including an actuating mechanism drivingly connected with the drive means for the nozzle to vary the radial length and pattern of discharge of water corresponding to the rotational speed of the nozzle with the greatest radial length of discharge of water occuring when the nozzle is travelling at its slowest rotational speed, said diffuser means including a blade movable laterally of the nozzle and the stream of water passing therethrough to split the stream of water as it is being discharged from the nozzle when the blade intersects the stream of water, said nozzle including an inverted U-shaped cross-sectional configuration having an open bottom along a longitudinal portion thereof and extending to the discharge end thereof, said blade movable laterally of the nozzle and into and out of the stream of water passing therethrough from the bottom thereof.

13. The sprinkler assembly as defined in claim 12 wherein said blade is pivotally mounted on a support pin extending transversely across the open bottom of the nozzle, said blade having a thickness substantially smaller than the width of the nozzle and oriented centrally between opposite walls of the inverted U-shaped portion of the nozzle.

* * * * *